US008434619B2

(12) United States Patent
Honkawa

(10) Patent No.: US 8,434,619 B2
(45) Date of Patent: May 7, 2013

(54) APPARATUS FOR PRESENTING BOTANICAL ARRANGEMENTS

(75) Inventor: Bryan Honkawa, Los Angeles, CA (US)

(73) Assignee: Teleflora, LLC, Los Angeles, CA (US)

( * ) Notice: Subject to any disclaimer, the term of this patent is extended or adjusted under 35 U.S.C. 154(b) by 88 days.

(21) Appl. No.: 12/697,122

(22) Filed: Jan. 29, 2010

(65) Prior Publication Data

US 2011/0186620 A1 Aug. 4, 2011

(51) Int. Cl.
*B65D 85/52* (2006.01)

(52) U.S. Cl.
USPC ..... 206/423; 206/588; 206/592; 206/485

(58) Field of Classification Search ..... D11/155; 206/423, 485, 588, 592; 47/84; 248/152; 229/138
See application file for complete search history.

(56) References Cited

U.S. PATENT DOCUMENTS 4,726,468 A * 2/1988 Hesser et al. ..... 206/423
D371,323 S * 7/1996 Weder et al. ..... D11/164
D371,521 S * 7/1996 Weder et al. ..... D11/164
6,463,697 B2 * 10/2002 Weder et al. ..... 47/84
6,745,514 B1 * 6/2004 Myrland ..... 47/84
D617,205 S * 6/2010 Hernandez ..... D9/661
2003/0089080 A1 * 5/2003 Weder et al. ..... 53/390
2003/0192803 A1 * 10/2003 Weder ..... 206/423
2007/0095694 A1 * 5/2007 Weder ..... 206/423

OTHER PUBLICATIONS

Laszlo Roth and George Wybenga, The Packaging Designers Book of Patterns, 1991, Van Nostrand Reinhold, p. 167-171.*

* cited by examiner

*Primary Examiner* — J. Gregory Pickett
*Assistant Examiner* — Raven Collins
(74) *Attorney, Agent, or Firm* — Cotman IP Law Group, PLC

(57) ABSTRACT

A botanical presentation assembly including a botanical gift box folded from a foldable sheet-like material configured to receive flowers. The flowers have a hidden portion configured to be placed in the botanical gift box. At least one sheet of decorative wrapping material is placed partially within the botanical gift box and interposed between the flowers and the botanical gift box.

17 Claims, 5 Drawing Sheets

APPARATUS FOR PRESENTING BOTANICAL ARRANGEMENTS

BACKGROUND OF THE INVENTION

1. Field of the Invention

Embodiments of the invention described herein pertain to the field of presenting botanical arrangements such as fresh cut, dried or live planted flowers or other plant matter. More particularly, but not by way of limitation, one or more embodiments of the invention botanical gift box are directed to an apparatus for presenting botanical arrangements.

2. Description of the Related Art

Gifts are a long-standing way to express gratitude and appreciation. Gifts are commonly presented for birthdays, weddings, anniversaries, graduation, house warming, baby showers, and other personal events. Gifts are also exchanged at holidays, such as Valentine's Day, Mother's Day, Father's Day, Christmas, and other holidays. Gifts may also be presented for other reasons, including token gifts to show respect, appreciation, or decorum.

Traditional gift wrapping involves placing the present in a box and wrapping the box with wrapping paper. As used herein, the term "traditional" refers to common practice. Wrapping paper is widely available in numerous patterns, including solid colors and designs of repeating patterns or non-repeating patterns. Wrapping paper is also available in various finishes, including matte glossy finish, metallic and other finishes. Wrapping paper may also be textured. Most traditional wrapping paper and other gift-wrapping material are paper-based. The paper-based materials have specific unique characteristics that are associated with traditional gift wrapping, such as a look, feel and other characteristics.

Considerable effort is often put into gift wrapping, as the attractive and detailed presentation of a gift is a significant element of the social practice of gift giving. The attractiveness of a gift is often associated with a level of care and effort put into the gift itself. A wrapped gift may be embellished with ribbons, bows, cards, tags, as well as other embellishments.

Flowers have also become a widespread form to express gratitude and appreciation. Flowers are often given along with a gift, as well as standing alone as the gift itself. Both life plants and fresh cut plants are given to recipients in the practice of gift giving. Botanical presentations are often packaged with a flask of water to promote the fresh appearance of the flowers without additional care for a longer period.

Although flowers have become a standard gift choice, flowers are not typically compatible with traditional gift wrapping. Both live plants and fresh cut plants require moisture to promote the fresh appearance for a desirable longer period. However, moisture damages paper-based wrapping paper. Additionally, other paper-based gift-wrapping materials, including tissue paper, are particularly sensitive to moisture. Wrapping paper and tissue paper damaged by moisture ruin the aesthetics of a traditionally wrapped gift.

There is no flower arrangement which emulates the characteristics of a traditional wrapped gift, such as the look and feel of traditional gift-wrapping material. There is a need for a botanical gift box which overcomes the problems and limitations described above.

BRIEF SUMMARY OF THE INVENTION

One or more embodiments are directed to an apparatus for presenting botanical arrangements. In the examples given here one or more embodiments are described as a botanical gift box that emulates at least one characteristic of a traditional wrapped gift, such as the look and feel of traditional gift-wrapping material.

One or more embodiments set forth herein are directed to enable an assembly for presenting botanical arrangements such as fresh cut, dried, and live planted flowers and other such plant life. The botanical presentation assembly is made of botanical gift box foldable sheet-like material that when assembled provides a repository for the botanical arrangements. When fully assembled the apparatus appears to be a gift-box with the flowers or other attractive plant life protruding from the apparatus. The foldable sheet-like material may be a paper-based material with a waterproofing layer.

The botanical arrangements have a hidden portion to be placed in the botanical gift box such that the hidden portion is placed in the interior of the botanical gift box. The hidden portion of the assembly for presenting botanical arrangements includes a flask that holds water or moisture. The flask is placed in the botanical gift box assembly with the at least one sheet of decorative material interposed between the flask and the assembly itself which in one embodiment of the invention takes the form of a botanical gift box.

At least one sheet of decorative wrapping material is placed at least partially within the botanical gift box for presenting botanical arrangements and interposed between the botanical arrangements and the botanical gift box assembly itself. Each sheet of decorative wrapping material may be made of a layer of paper-based material coated with at least one waterproofing layer.

As is customarily the case with botanical or floral arrangements presented as gifts at least one of the botanical arrangements or flowers, a design of the assembly itself, and the decorative sheet material may be selected based on a theme.

One or more embodiments set forth herein enable a pattern for assembling the apparatus for presenting botanical arrangements such as flowers. The pattern is constructed from a foldable sheet-like material. The foldable sheet-like material may be a paper-based material coated with a box waterproofing layer. The pattern has an exterior surface corresponding to a surface of the foldable sheet-like material. The exterior surface has at least one characteristic of traditional gift-wrap and can have various designs printed thereon. In one or more embodiments, the exterior surface is designed based on a theme and the design corresponds to that theme. Furthermore, the exterior surface may be colored and/or processed to achieve a surface finish. When assembled the patterns folds into the apparatus for presenting botanical arrangements and has at least a portion of the exterior surface facing outward.

The pattern includes a first side panel, a second side panel, a third side panel, and a fourth side panel connected at parallel edges to form a single row of four side panels. The parallel edges fold to an angle of about 90° away from the exterior surface. The side panels may be squares with a side of length s.

The panel further includes a flap connected to the first side panel. The flap is configured to couple with the fourth side panel at a flap overlap when the parallel edges are folded at about 90° away from the exterior surface. At least a portion of the flap overlap may be reinforced.

The pattern further includes four support extensions extending from a top edge of each of the side panels. Each support extension may be in the shape of an isosceles triangle. The support extensions fold to a support extension angle. The support extension angle may be between about 90° and about 180° with respect to the exterior surface. In one or more embodiments, the support extension angle is between about 120° and about 180° with respect to the exterior surface. In one or more embodiments, the support extension angle is between about 150° and about 180° with respect to the exterior surface. In one or more embodiments, the support extension angle is between about 120° and about 150° with respect to the exterior surface.

The pattern further includes four base panels extending from a bottom edge of each of the side panels. The base panels interlock to form a base of a botanical gift box when the pattern is folded. At least a portion of the base may be reinforced.

In one or more embodiments, the four base panels include a first base panel, a second base panel, a third base panel, and a fourth base panel. A protruding corner of the second base panel overlaps with the fourth base panel and a protruding corner of the fourth base panel overlaps with the second base panel in a latching manner.

The first base panel is first base panel connected to a bottom edge of the first side panel, and the first base panel is trapezoidal. A distance between the first side panel and an outer parallel edge of the first base panel is h, wherein h is about half the length of s.

The second base panel connected to a bottom edge of the second side panel. An opposing edge of the second base panel extends a distance greater than h. An opposing edge protrusion of the second base panel extends further than the opposing edge. An opposing edge notch of the second base panel located between the opposing edges of the second base panel. The opposing edge protrusion of the second base panel extends a distance of about less than h.

The third base panel connected to a bottom edge of the third side panel, and the third base panel is trapezoidal. A distance between the third side panel and an outer parallel edge of the third base panel is h.

The fourth base panel connected to a bottom edge of the fourth side panel. An opposing edge of the fourth base panel extends a distance greater than h. An opposing edge protrusion of the fourth base panel extends further than the opposing edge. An opposing edge notch of the fourth base panel located between the opposing edges of the fourth base panel. The opposing edge protrusion of the fourth base panel extends a distance of about less than h.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

A botanical gift box will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
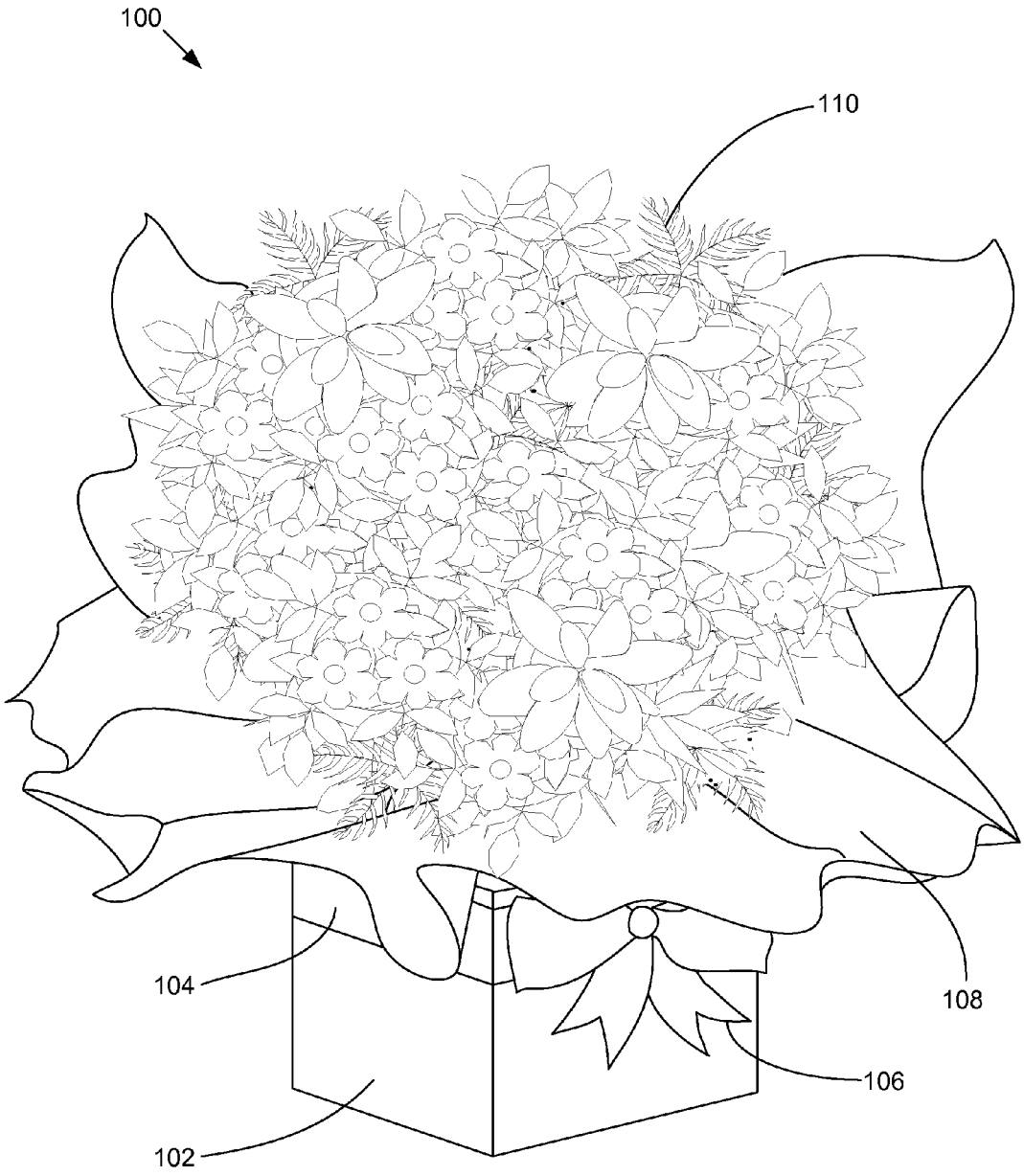
FIG. 1 illustrates a botanical presentation assembly in accordance with one or more embodiments of the described botanical gift box.

FIG. 1 illustrates a botanical presentation assembly in accordance with one or more embodiments of the described botanical gift box. Botanical presentation assembly 100 includes botanical gift box 102. Botanical gift box 102 is configured to support botanical arrangement 110. As used herein, the term "botanical arrangement" refers to any arrangement of botanical elements, including fresh cut, dried and live planted flower arrangements, bouquets, flowers or other plant matter.

A boxed portion of botanical arrangement 110 is placed into botanical gift box 102. The boxed portion may include any portions to be hidden from view in an interior of botanical gift box 102, such as stems, containers, soil, pots, or any other portion to be hidden from view. The boxed portion may comprise a means to bundle the botanical arrangement, such as a rubber band, a tie, wire, a pot, a container, or any other means suitable for bundling the flowers.

A portion may be hidden from view to enhance the attractiveness of botanical presentation assembly 100. In one or more embodiments, a portion of botanical arrangement 110 is hidden from view in botanical gift box 102 such that botanical presentation assembly 100 more closely resembles a traditional wrapped gift.

Botanical gift box 102 may include one or more support extensions configured to support and position botanical arrangement 110 in a desirable and attractive configuration, such as the support extensions shown in FIGS. 2-5.

Botanical gift box 102 is constructed from a foldable sheet-like material, such as plastic, paper, cardboard, fabric, or any other foldable sheet-like material. In one or more embodiments, botanical gift box 102 is constructed by folding a pattern cut from the foldable sheet-like material. An exemplary pattern used in one or more embodiments of the botanical gift box is described in FIG. 3. Folded botanical gift box 102 may be reinforced by glue, tape, adhesive, heat, or any other method for affixing a surface of a foldable sheet-like material to itself.

Botanical gift box 102 may be printed, painted, coated, dyed, or otherwise colored with a solid color or a design comprising a repeating or non-repeating pattern. Furthermore, the exterior surface of botanical gift box 102 may be printed, painted, coated, dyed, or otherwise processed to achieve a matte finish, a glossy finish, a waterproof finish, a metallic finish, or other any other surface texture or appearance.

In one or more embodiments, a design and/or finish on the exterior of botanical gift box 102 is achieved by dyeing, printing, painting, coating, treating or otherwise processing a sheet of material from which the botanical gift box 102 is constructed. In one or more embodiments, the exterior surface of botanical gift box 102 is designed to have at least one characteristic of gift wrap for wrapping a traditional gift, including texture, feel, color, design, finish and any other property of gift wrap.

In one or more embodiments, botanical gift box 102 comprises paper-based material and at least one surface of botanical gift box 102 is coated with a waterproofing layer. Both an interior surface and an exterior surface of the layer of paper-based material may be coated with a waterproofing layer. The waterproofing layer is applied by spraying, painting, heat, bonding, or any other method of applying a waterproofing layer to a surface. The waterproofing layer may comprise wax, plastic, laminate, or any other suitable material for waterproofing.

In one or more embodiments, botanical gift box 102 is decorated with one or more embellishments 104-106. The one or more embellishments 104-106 may be configured to resemble embellishments traditionally added to the exterior of a gift wrapped in gift wrap. Exemplary embellishments include at least one gift tag, balloon, card, printed message, curled ribbon, wrapped ribbon 104 wrapped around an exterior surface of botanical gift box 102, decorative bow 106 located on the exterior surface of botanical gift box 102, and any other decorative embellishment.

Botanical presentation assembly 100 further includes at least one sheet of decorative wrapping material 108. Decorative wrapping material 108 is placed between botanical arrangement 110 and botanical gift box 102. Decorative wrapping material 108 may be configured to fill empty space in botanical gift box 102, secure a position of botanical arrangement 110 within botanical gift box, and/or enhance the appearance of botanical presentation assembly 100.

Suitable materials for decorative wrapping material 108 include tissue paper, foil, cellophane, or any other decorative wrapping material. In one or more embodiments, decorative wrapping material 108 is designed to resemble a characteristic of tissue paper or other decorative wrapping material used with a traditional wrapped gift.

Decorative wrapping material 108 may be processed to achieve a matte finish, a glossy finish, a waterproof finish, a metallic finish, a smooth texture, a crinkled texture, a shredded appearance, or other any other surface texture or appearance. Decorative wrapping material 108 may be printed, painted, coated, dyed or otherwise colored with a solid color or a design comprising a repeating or non-repeating pattern. When more than one sheet of decorative wrapping material is used in botanical presentation assembly 100, more than one size, color and/or pattern of decorative wrapping material may be used. Alternatively, identical sheets of decorative wrapping material may be used. In one or more embodiments, decorative wrapping material 108 includes one or more sheets of tissue paper wherein each sheet comprises at least one surface coated with a waterproofing layer.

The overall appearance of botanical presentation assembly 100 may emulate at least one characteristic of a traditional wrapped gift. Botanical presentation assembly 100 comprises botanical arrangement 110 placed into botanical gift box 102 with at least one sheet of decorative wrapping material 108 interposed between botanical arrangement 110 and botanical gift box 102. Embellishments 104-106 are coupled with botanical gift box 102.

In one or more embodiments, at least one of botanical arrangement 110, botanical gift box 102, decorative wrapping material 108 and embellishments 104-106 are selected to emulate a theme. A theme may be emulated by incorporating one or more colors, finishes, textures, patterns, symbols, text, and any other characteristic in botanical presentation assembly 100. The theme may be a theme associated with traditional gift giving and/or flowers.

For example, themes include birthday, wedding, anniversary, graduation, get well, congratulations, house warming, baby, and any other personal event where traditional wrapped gifts and/or flowers are appropriate.

Themes also include holidays, including Valentine's Day, Mother's Day, Father's Day, Thanksgiving, Chanukah, Christmas, and any other holiday where traditional wrapped gifts and/or flowers are appropriate. Themes may also include other holidays which are celebrated, including Easter, Independence Day, Halloween, Thanksgiving, New Year's, and any other holiday.

Themes also include design themes. As used herein, the term "design theme" refers to any adjective or phrase capable of describing an overall look of the appearance of a botanical presentation assembly.

In one or more embodiments, a selection of two or more flower presentation assemblies is advertised in association with a selected theme.

When a theme is based on a universally recognized date, such as a holiday, a selection of two or more flower presentation assemblies based on the theme is advertised during an appropriate advertising period prior to the holiday.

When a theme is a not based on a universally recognized date, such as a design theme, a personal event, or any other theme not based on a universally recognized date, a selection of two or more flower presentation assemblies based on the theme may be advertised in a category under the theme. For example, the selection of two or more flower presentation assemblies based on the theme may be advertised under the theme in a printed catalog, an online catalog, a printed publication, a broadcast publication, a flyer, a streaming advertisement, an Internet advertisement, or any other advertisement media, including text and audio-visual media.

Figure 2:
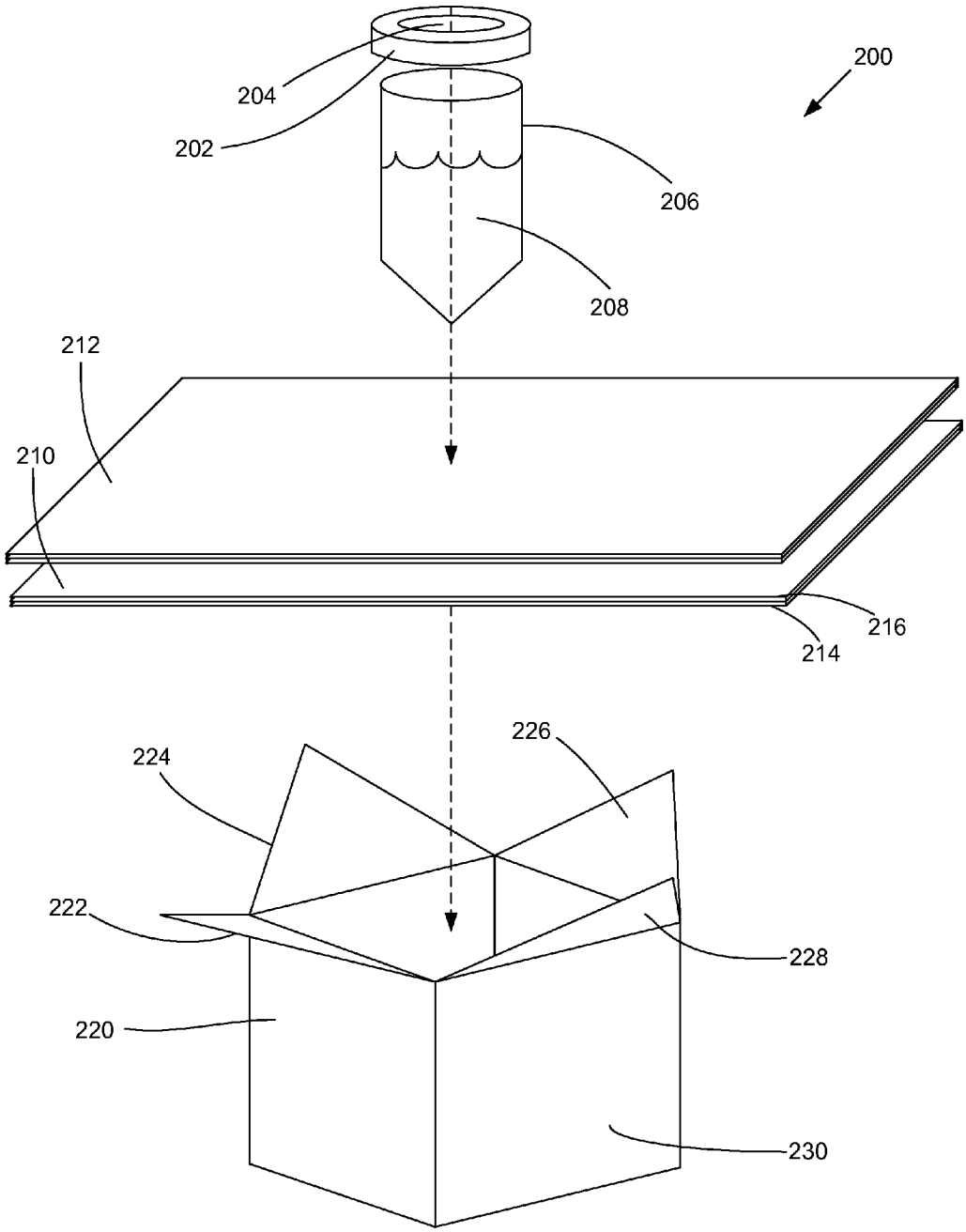
FIG. 2 illustrates an exploded view of a botanical presentation assembly in accordance with one or more embodiments of the described botanical gift box.

FIG. 2 illustrates an exploded view of the botanical presentation assembly in accordance with one or more embodiments of the described botanical gift box. Botanical presentation assembly 200 includes botanical gift box 220. Botanical gift box 220 includes support extensions 222-228. Support extensions 222-228 are configured to support and position flowers 102 in a desirable and attractive configuration.

Support extensions 222-228 extend upward from the top border of botanical gift box 220. Although triangular support extensions 222-228 are shown, support extensions 222-228 may be constructed in any shape which extends from the top border of botanical gift box 220.

In one or more embodiments, support extension 222-229 are each configured to extend from a surface of botanical gift box 220 to form an angle of between about 90° and about 180° with respect to an exterior surface of botanical gift box 220. In one or more embodiments, each support extension is configured to extend from a surface of botanical gift box 220 to form an angle of between about 120° and about 180° with respect to an exterior surface of botanical gift box 220. In one or more embodiments, each support extension is configured to extend from a surface of botanical gift box 220 to form an angle of between about 150° and about 180° with respect to an exterior surface of botanical gift box 220. In one or more embodiments, each support extension is configured to extend from a surface of botanical gift box 220 to form an angle of between about 120° and about 150° with respect to an exterior surface of botanical gift box 220.

Botanical gift box 220 further includes at least one sheet of decorative wrapping material 210-212. Decorative wrapping material 210-212 is placed between flowers and botanical gift box 220. Decorative wrapping material 210-212 includes tissue paper, foil, cellophane, or any other decorative sheet material. In one or more embodiments, decorative wrapping material 210-212 is designed to resemble a characteristic of tissue paper or other decorative wrapping material used with a traditional wrapped gift.

Decorative wrapping material 210-212 may be processed to achieve a matte finish, a glossy finish, a waterproof finish, a metallic finish, a smooth texture, a crinkled texture, a shredded appearance, or other any other surface texture or appearance. Decorative wrapping material 210-212 may be printed, painted, coated, dyed or otherwise colored with a solid color or a design comprising a repeating or non-repeating pattern. When more than one sheet of decorative wrapping material is used in botanical presentation assembly 200, more than one size, color and/or pattern of decorative wrapping material may be used. Alternatively, identical sheets of decorative wrapping material may be used.

In one or more embodiments, a sheet of decorative wrapping material 210 includes a layer of paper-based material 214 comprising at least one surface coated with a waterproofing layer 216. In one or more embodiments, both a top surface and a bottom surface of the layer of paper-based material 214 are coated with a waterproofing layer. The waterproofing layer is applied by spraying, painting, heat, bonding, or any other method of applying a waterproofing layer to a surface. The waterproofing layer may comprise wax, plastic, laminate, or any other suitable material for waterproofing.

As indicated by the dashed arrow, botanical presentation assembly 200 comprises flowers (not shown in FIG. 2) placed into botanical gift box 220 with at least one sheet of decorative wrapping material 210-212 interposed between the flowers and botanical gift box 220.

Botanical gift box 220 further includes flowers. In one or more embodiments, a boxed portion of the flowers is placed into botanical gift box 220. The boxed portion may include any portions to be hidden from view, such as stems, containers, soil, pots, or any other portion to be hidden from view. The boxed portion may comprise a means to bundle the flowers, such as a rubber band, a tie, wire, a pot, a container, or any other means suitable for bundling the flowers.

A portion may be hidden from view to enhance the attractiveness of botanical presentation assembly 200. In one or more embodiments, a portion of the flowers is hidden from view within botanical gift box 220 such that botanical presentation assembly 100 more closely resembles a traditional wrapped gift.

In one or more embodiments, the boxed portion comprises a flask 206 configured to receive one or more stems of the flowers of botanical presentation assembly 200. Flask 206 may contain a fluid 208 comprising water. The quantity of fluid 208 in flask 206 is sufficient to promote the health and/or fresh appearance of the flowers without additional care for at least a freshness period. As used herein, the term "freshness period" refers to a period of time that a consumer and/or recipient of botanical presentation assembly 200 can reasonably expect the flowers to have a fresh appearance without additional care.

In one or more embodiments, flask 206 contains a plant substrate suitable for the type of flower, such as soil, vermiculite, bark, moss, or any other substrate which promotes one or more flowers, as well as the necessary moisture to promote the health and/or fresh appearance of the flowers without additional care for at least a freshness period. The substrate is chosen to prolong the life of fresh cut flowers or to promote the health of live flowers, including live plants with an established root system that is placed in the plant substrate.

Fluid 208 may also contain one or more plant nutrients dissolved into fluid 208. The plant nutrients may include a time-release fertilizer which becomes biologically available over the time-release period. In one or more embodiments, flask 206 is manufactured out of a waterproof material embedded with a time-release fertilizer that dissolves into fluid 208 over time, becoming biologically available over the time-release period. The time-release period of the fertilizer may be selected based on a freshness period associated with botanical presentation assembly 200.

Flask 206 may have a flat, curved, or angular bottom. The size, shape and volume of flask 206 can be configured based on the type and amount of flowers which are placed in flask 206, the size and shape of botanical gift box 220 and/or a desired freshness period for botanical gift box 220.

Flask 206 may comprise a rim to minimize fluid 208 which escapes flask 206 during normal movement of botanical presentation assembly 200. The rim may be provided on lid 202. In one or more embodiments, lid 202 comprises a ring designed to create a seal with flask 206. Lid 202 further comprises receiving hole 204 configured to receive a stem portion of flowers. Receiving hole 204 may be sized to hold the flowers in a bundle such that the edge of receiving hole 204 is in contact with the flowers, minimizing the amount of fluid 208 which escapes flask 206. In one or more embodiments, lid 202 is constructed from an elastic material, such as rubber or any other elastic material.

Figure 3:
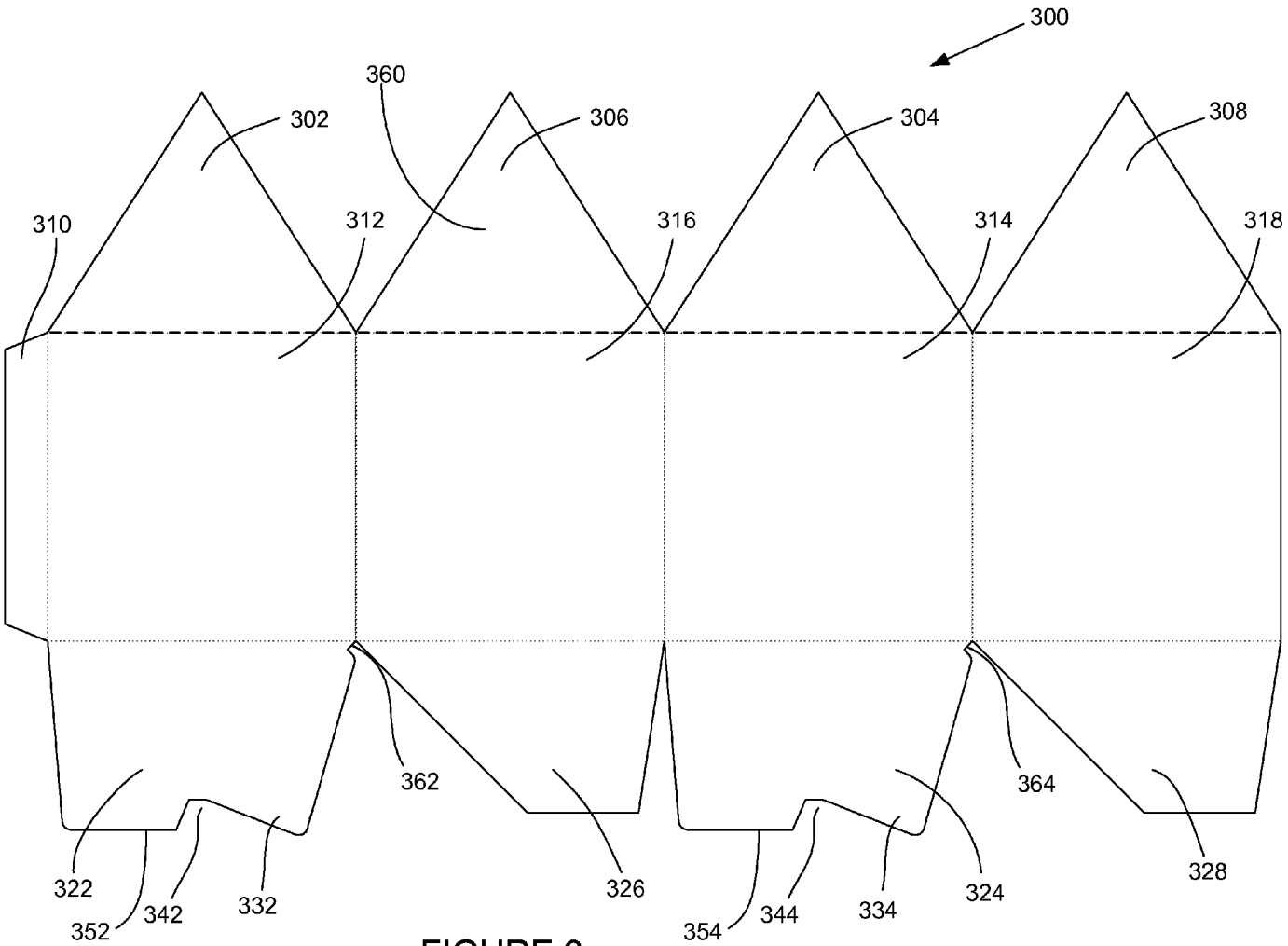
FIG. 3 illustrates a pattern for a botanical gift box in an unfolded position in accordance with one or more embodiments of the described botanical gift box.

FIG. 3 strates a pattern for a botanical gift box in an unfolded position in accordance with one or more embodiments of the described botanical gift box. Pattern 300 is constructed from a foldable sheet-like material, such as plastic, paper, cardboard, or any other foldable sheet-like material. In one or more embodiments, the foldable sheet-like material is manufactured in the shape of pattern 300. Alternatively, pattern 300 is cut from a larger sheet the foldable sheet-like material using one or more lasers, preformed cutters, heat, or any other apparatus for cutting a pattern from the foldable sheet-like material.

An exterior surface 360 of pattern 300 comprises the visible portion of pattern 300 in FIG. 3. Exterior surface 360 may be printed, painted, coated, dyed, or otherwise decorated. Furthermore, exterior surface 360 may be processed to achieve a matte finish, a glossy finish, a waterproof finish, a metallic finish, or other any other surface texture or appearance.

In one or more embodiments, a design and/or finish of exterior surface 360 is achieved by dyeing, printing, painting, coating, treating or otherwise processing the foldable sheet-like material of pattern 300 before or after the material is formed into pattern 300. In one or more embodiments, exterior surface 360 is designed to have at least one characteristic of gift wrap, including texture, feel, color, pattern, finish and any other property of gift wrap. In one or more embodiments, at least one surface of pattern 300 is coated with a waterproofing layer.

The botanical gift box folded from pattern 300 may be reinforced at least at one overlapping surface using glue, tape, adhesive, heat, or any other method of affixing surfaces of the foldable sheet-like material. Any glue, tape or other adhesive used may be applied as a liquid, spray, gel, or solid to pattern 300 before, during or after folding pattern 300 into a botanical gift box.

A botanical gift box with an exterior comprising exterior surface 360 is folded from pattern 300 by folding away from exterior surface 360 along the dotted lines at about a 90° angle and folding toward exterior surface 360 along the dashed lines.

Pattern 300 includes support extensions 302-308. Support extensions 302-308 are configured to support and position flowers placed into a folded botanical gift box in a desirable and attractive configuration.

In one or more embodiments, the dashed lines are folded to create a support extension angle of between about 90° and about 180° on the exterior surface. In one or more embodiments, the dashed lines are folded to create a support extension angle of between about 120° and about 180° on the exterior surface. In one or more embodiments, the dashed lines are folded to create a support extension angle of between about 150° and about 180° on the exterior surface. In one or more embodiments, the dashed lines are folded to create a support extension angle of between about 120° and about 150° on the exterior surface. In one or more embodiments of the invention, dashed lines and dotted lines are partially scored and/or manufactured with a thinner layer of material.

The angle on the exterior surface formed by a side panel 312-318 and a support extension 302-308 is variable based on the final positioning of flowers within the folded botanical gift box. A smaller angle on the exterior surface will accommodate a larger quantity of flowers closer to the botanical gift box, while a larger angle on the exterior surface will accommodate a smaller quantity of flowers or flowers positioned further from the botanical gift box.

Pattern 300 further includes side panels 312-318. Each side panels comprises a square. Side panels 312-318 are connected to each other on pattern 300 at parallel edges to form a single row. Side panels 312-318 fold to form the sides of a botanical gift box.

Pattern 300 further includes flap 310. Flap 310 protrudes from the edge of side panel 312. When folded, flap 310 overlaps with side panel 318. The folded botanical gift box folded from pattern 300 may be reinforced between flap 310 and side panel 318 using glue, tape, adhesive, heat, or any other method of affixing surfaces of the foldable sheet-like material. Any glue, tape or other adhesive used may be applied as a liquid, spray, gel, or solid to flap 310 before, during or after folding pattern 300.

Pattern 300 includes base panels 322-328. Base panels 322-328 include interlocking base panels 322-324 and trapezoid base panels 326-328. When pattern 300 is folded into a botanical gift box, base panels 322-328 are interlocked. The folded botanical gift box folded from pattern 300 may be reinforced at least at one overlapping surface of base panels 322-328 using glue, tape, adhesive, heat, or any other method of affixing surfaces of the foldable sheet-like material. Any glue, tape or other adhesive used may be applied as a liquid, spray, gel, before, during or after folding pattern 300. Alternatively, base panels 322-328 are not reinforced with glue, tape, adhesive, heat, or any other method of affixing the overlapping surfaces.

Interlocking base panels 322-324 comprise corner notches 362-364. Corner notches 362-364 are configured to provide space to allow trapezoidal base panels 326-328 to overlap with interlocking base panels 326-328.

Interlocking base panels 322-324 further comprise opposing edges 352-354. Opposing edges 352-354 extend a distance greater than half the length of the long edge of interlocking base panels 322-324 such that each interlocking base panel 322-324 extends further than halfway across base of the botanical gift box when pattern 300 is folded.

Interlocking base panels 322-324 further comprise opposing edge notches 342-344. Opposing edge notches 332-334 extend a distance of slightly less than half the length of the long edge of interlocking base panels 322-324. When pattern 300 is folded into a botanical gift box, the center of the botanical gift box's base is located at an intersection point of the border of opposing edge notch 342 and opposing edge notch 344. Interlocking base panels 322-324 are configured to latch together at opposing edge notches 342-344.

Interlocking base panels 322-324 further comprise opposing edge protrusions 332-334. Opposing edges protrusions 332-334 extend a distance greater than the distance of opposing edges 352-354 from side panels 312-314.

Trapezoid base panels 326-328 have a trapezoidal shape. A distance between the long edge and the outer parallel edge of the trapezoidal shape half the length of the long edge such that each trapezoid base panel 326-328 extends about halfway across base of the botanical gift box when pattern 300 is folded.

Figure 4:
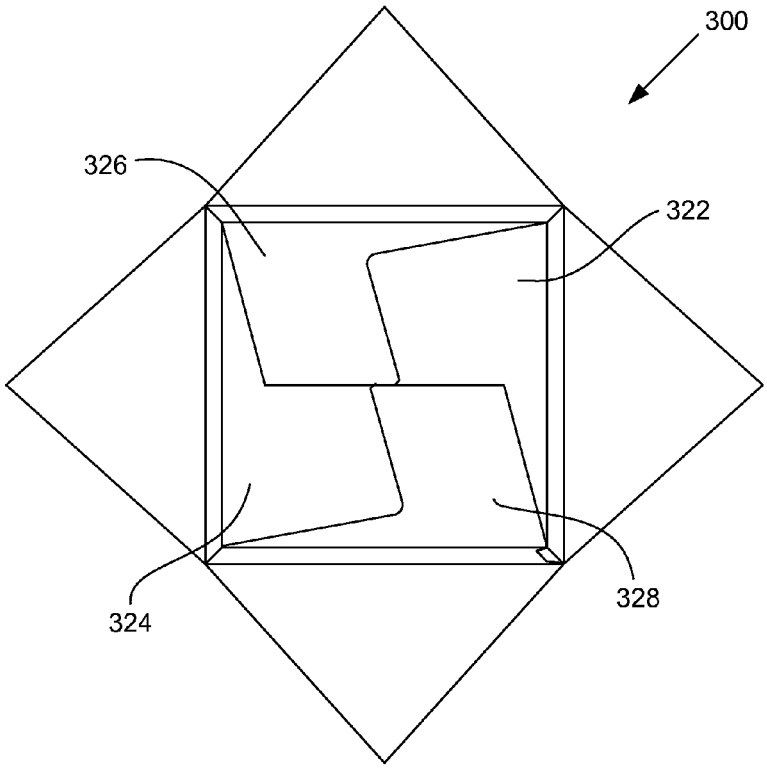
FIG. 4 illustrates a top view of a botanical gift box in a folded position in accordance with one or more embodiments of the described botanical gift box.

FIG. 4 illustrates a top view of a botanical gift box in a folded position in accordance with one or more embodiments of the described botanical gift box. Base panels 322-328 are interlocked.

Optionally, at least one overlapping surface of base panels 322-328 is reinforced using glue, tape, adhesive, heat, or any other method of affixing surfaces of the foldable sheet-like material.

Figure 5:
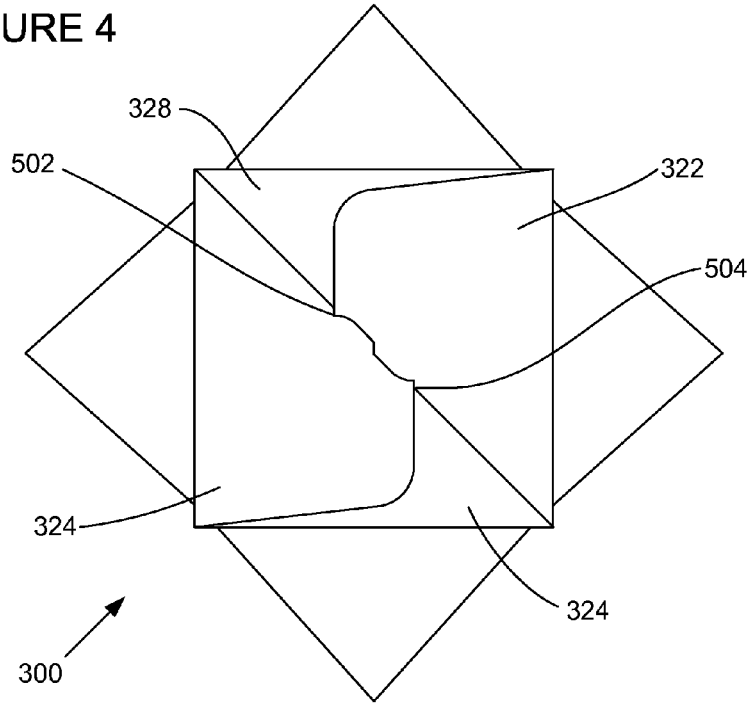
FIG. 5 illustrates a bottom view of a botanical gift box in a folded position in accordance with one or more embodiments of the described botanical gift box.

FIG. 5 illustrates a bottom view of a botanical gift box in a folded position in accordance with one or more embodiments of the described botanical gift box. Base panels 322-328 are folded to interlock. Each of interlocking base panels 322-324 overlaps with a portion of all of the other base panels. Each of trapezoid base panels 326-328 overlaps with a portion of the adjacent base panels as shown in FIG. 3. In one or more embodiments, a protruding corner 502 of interlocking base panel 322 overlaps with interlocking base panel 324, and a protruding corner 504 of interlocking base panel 324 overlaps with interlocking base panel 322. Protruding corners 502-504 may be configured to latch interlocking base panels 322-324 together.

Optionally, at least one overlapping surface of base panels 322-328 is reinforced using glue, tape, adhesive, heat, or any other method of affixing surfaces of the foldable sheet-like material.

In one or more embodiments pattern 300 has the dimensions listed in Table 1. One of ordinary one of ordinary skill in the art would appreciate that the dimensions of pattern 300 may be scaled such that the resulting pattern folds into a cube of scaled size in the same manner as pattern 300 without departing from the spirit and scope of the invention. Furthermore, one of ordinary one of ordinary skill in the art would appreciate that the deviations from the dimensions of Table 1 can be made without departing from the spirit and scope of the invention.

TABLE 1

| | Dimensions | |
|---|---|---|
| Element of Pattern (300) | Shape | Dimension (inches) |
| support extensions (302-308) | Isosceles triangle | 4½" base<br>3½" height |
| side panels (312-318) | Square | 4½" side |
| trapezoid base panels (322-324) | Trapezoid | 2¼" height<br>1 19/32" side<br>4½" side<br>one 45° angle |
| interlocking base panels (326-328) | — | 2¾" to edge (352-354)<br>2⅞" to protrusion (332-334) |
| Flap (310) | Trapezoid | ⅝" height |

TABLE 1-continued

| Dimensions | | |
|---|---|---|
| Element of Pattern (300) | Shape | Dimension (inches) |
| | | 4" side<br>4½" side |

The specific pattern shown in FIG. 3 is a single piece of material which folds into a cube. The specific pattern shown includes four support extensions 302-308, four side panels 312-318, and four interlocking base panels 322-328. However, one of ordinary skill in the art would appreciate that a pattern may comprising more than one piece without departing from the spirit and scope of the invention. Furthermore, one of ordinary one of ordinary skill in the art would appreciate that a pattern may be configured to fold into a rectangular prism without departing from the spirit and scope of the invention. Furthermore, one of ordinary skill in the art would appreciate that a pattern may be configured to fold into a three-dimensional polygon shape without departing from the spirit and scope of the invention.

Figure 6:
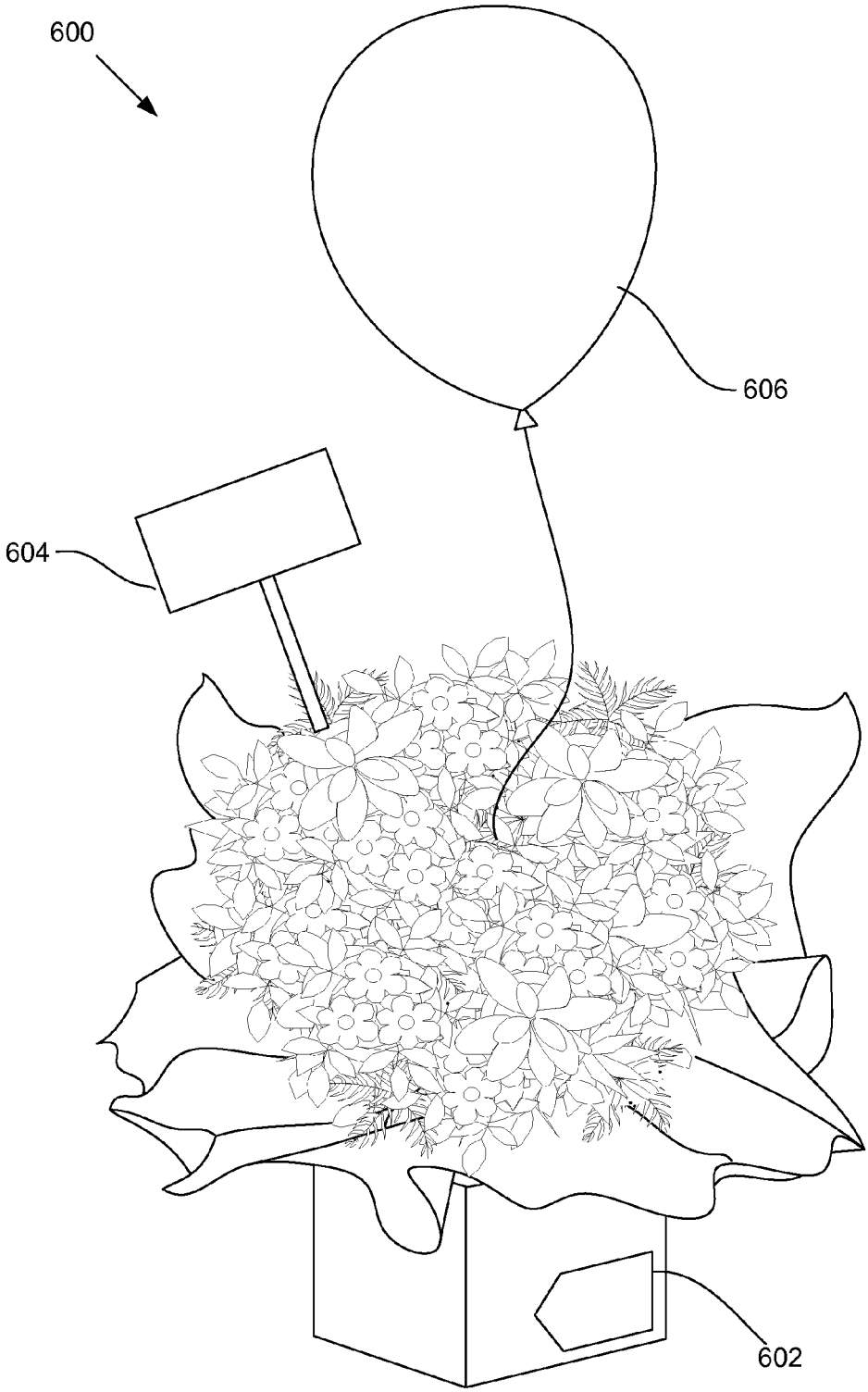
FIG. 6 illustrates a botanical presentation assembly in accordance with one or more embodiments of the described botanical gift box.

FIG. 6 illustrates a botanical presentation assembly in accordance with one or more embodiments of the described botanical gift box. Specifically, FIG. 6 shows additional exemplary embellishments attached to a botanical gift box or another portion of botanical presentation assembly 600.

Botanical presentation assembly 600 includes tag 602. Tag 602 may be a gift tag, a logo, a decal, or any other tag. Tag 602 may be affixed to the botanical gift box using glue or another adhesive. Tag 602 may also be a part of the design of a foldable sheet-like material from which the botanical gift box is made. The area of tag 602 may be treated to provide a writing surface.

Botanical presentation assembly 600 also includes stake 604. Stake 604 is incorporated into the flowers of botanical presentation assembly 600. Stake 604 may be attached to a card which comprises a printed text message or a writing surface for a personally written message. Stake 604 may also be attached to an object, such as a plastic object, a stuffed animal, an edible object, and/or an object selected based on a theme of botanical presentation assembly 600.

Botanical presentation assembly 600 also includes at least one balloon 606. The at least one balloon 606 is incorporated into the flowers of botanical presentation assembly 600. The at least one balloon 606 may comprise a Mylar or latex balloon of a solid color or a design, including a printed message.

While the invention herein disclosed has been described by means of specific embodiments and applications thereof, numerous modifications and variations could be made thereto by those skilled in the art without departing from the scope of the invention set forth in the claims.

What is claimed is:

1. A botanical presentation assembly comprising:

a botanical gift box folded from a foldable sheet-like material configured to receive a botanical arrangement, said botanical gift box comprising a plurality of side panels and a plurality of support extensions, wherein each one of said plurality of side panels has a top edge and a bottom edge and at least one of said plurality of support extensions extending from said top edge and folded at an angle of between about 120° to about 180° from vertical and towards the center of said botanical gift box;

a botanical arrangement comprising a displayed portion and a hidden portion, wherein said displayed portion comprises at least one flower extending beyond said top edge of said plurality of side panels and said hidden portion comprises portions of said at least one flower to be hidden from view, said hidden portion configured to be placed in a flask located within said botanical gift box; and at least one sheet of decorative wrapping material, wherein said at least one sheet of decorative wrapping material is placed at least partially within said botanical gift box and interposed between said botanical arrangement and interior of said botanical gift box, wherein said plurality of support extensions are configured to support and position said displayed portion of said botanical arrangement extending from said botanical gift box, and wherein an exterior surface of said plurality of support extensions is configured to structurally support said botanical arrangement.

2. The botanical presentation assembly of claim 1, wherein said foldable sheet-like material is paper-based and comprises a waterproofing layer.

3. The botanical presentation assembly of claim 1, wherein each sheet of said at least one decorative wrapping material comprises a layer of paper-based material coated with at least one waterproofing layer.

4. A botanical presentation assembly comprising:

a botanical gift box folded from a foldable sheet-like material configured to receive a botanical arrangement said botanical gift box comprising a plurality of side panels and a plurality of support extensions folded at an angle of between about 120° to about 180° with respect to vertical and such that said plurality of support extensions are pointed towards the center of said botanical gift box;

a botanical arrangement comprising a displayed portion of at least one flower, wherein said botanical arrangement further comprises a hidden portion excluding said displayed portion of said at least one flower, said hidden portion configured to be placed in an interior of said botanical gift box, wherein said displayed portion extends beyond said plurality of side panels; and at least one sheet of decorative wrapping material, wherein said at least one sheet of decorative wrapping material is placed at least partially within said botanical gift box and interposed between said botanical arrangement and interior said botanical gift box, wherein said plurality of support extensions are configured to support and position said displayed portion of said botanical arrangement extending from said botanical gift box, wherein exterior surface of said plurality of support extensions is configured to structurally support said botanical arrangement, and wherein said hidden portion further comprises a flask comprising moisture, wherein said flask is placed in said botanical gift box with said at least one sheet of decorative material interposed between said flask and said botanical gift box.

5. The botanical presentation assembly of claim 1, wherein each one of said plurality of support extensions is triangular in shape and a base of a support extension is coupled to said top edge of a side panel.

6. A botanical gift box assembly comprising:

a botanical gift box folded from a foldable pattern constructed from a foldable sheet-like material, wherein said foldable pattern comprises:

an exterior surface of said foldable sheet-like material configured to have at least one characteristic of traditional gift wrap;

a plurality of side panels comprising a first side panel, a second side panel, a third side panel, and a fourth side panel coupled at parallel edges to form a single row of four side panels, wherein said parallel edges are configured to fold to an angle of about 90° away from said exterior surface;

a flap coupled with said first side panel, wherein said flap is configured to couple with said fourth side panel at a flap overlap when said parallel edges are folded at about 90° away from said exterior surface;

four support extensions configured such that one of said four support extensions extends from a top edge of one of said four side panels, wherein said support extensions are configured to fold to a support extension angle of between about 120° to about 180° from vertical and towards the center of said botanical gift box; and four base panels configured such that one of said four base panels extends from a bottom edge of one of said four side panels, wherein said base panels are configured to fold 90° towards the center of said botanical gift box and interlock to form a base of a botanical gift box; and a botanical arrangement comprising at least one flower, wherein said botanical arrangement comprises a displayed portion of said at least one flower, wherein said botanical arrangement further comprises a hidden portion excluding said displayed portion of said at least one flower, said hidden portion configured to be placed in said botanical gift box such that said hidden portion is placed in a flask located in an interior of said botanical gift box, wherein said displayed portion extends beyond said plurality of side panels, wherein said foldable pattern is configured to fold into said botanical gift box with at least a portion of said exterior surface facing outward, wherein said four support extensions are configured to support and position said displayed portion of said botanical arrangement, wherein said flask contains moisture, and wherein said exterior surface of said plurality of support extensions are configured to at least indirectly contact said botanical arrangement.

7. The botanical gift box assembly of claim 6, wherein at least a portion of said flap overlap is reinforced.

8. The botanical gift box assembly of claim 6, wherein at least a portion of said base is reinforced.

9. The botanical gift box assembly of claim 6, wherein each of said support extensions is an isosceles triangle configured to symmetrically support said displayed portion of said botanical arrangement.

10. The botanical gift box assembly of claim 6, wherein said support extension angle is between about 120° and 150° with respect to vertical.

11. The botanical gift box assembly of claim 6, wherein said side panels are squares.

12. The botanical gift box assembly of claim 6, wherein said exterior surface of said foldable sheet-like material is decorated.

13. The botanical gift box assembly of claim 6, wherein said exterior surface of said foldable sheet-like material is processed to achieve a surface finish.

14. The botanical gift box assembly of claim 6, wherein said exterior surface is designed based on a theme.

15. The botanical gift box assembly of claim 6, wherein said foldable sheet-like material is paper-based.

16. The botanical gift box assembly of claim 6, wherein said foldable sheet-like material is coated with a box waterproofing layer.

17. The botanical gift box assembly of claim 6, further comprising at least one sheet of decorative wrapping material, wherein said at least one sheet of decorative wrapping material is placed at least partially within said botanical gift box and interposed between said botanical arrangement and said botanical gift box.

* * * * *